US005745050A

United States Patent [19]

Nakagawa

[11] Patent Number: 5,745,050

[45] Date of Patent: Apr. 28, 1998

[54] OBSTACLE DETECTION APPARATUS FOR VEHICLES

[75] Inventor: Tetsuya Nakagawa, Himeji, Japan

[73] Assignee: Mitsubishi Denki Kabushiki Kaisha

[21] Appl. No.: 429,189

[22] Filed: Apr. 26, 1995

[30] Foreign Application Priority Data

Oct. 21, 1994 [JP] Japan ..... 6-256707

[51] Int. Cl.[6] ..... G08G 1/16

[52] U.S. Cl. ..... 340/903; 340/901; 340/435; 340/436; 340/438; 180/167; 180/169; 250/236; 250/224

[58] Field of Search ..... 340/901–905, 340/435, 436, 438; 250/235, 236, 224; 180/167, 168, 169, 271

[56] References Cited

U.S. PATENT DOCUMENTS

| | | | |
|---|---|---|---|
| 4,558,215 | 12/1985 | Kaneko et al. | 250/222.1 |
| 4,668,859 | 5/1987 | Winterer | 250/221 |
| 4,849,731 | 7/1989 | Melocik | 340/435 |
| 5,026,153 | 6/1991 | Suzuki et al. | 340/903 |
| 5,122,796 | 6/1992 | Beggs et al. | 180/169 |
| 5,293,162 | 3/1994 | Bachalo | 340/901 |
| 5,519,377 | 5/1996 | Murphy | 340/904 |

FOREIGN PATENT DOCUMENTS

| | | |
|---|---|---|
| 3-175390 | 7/1991 | Japan . |
| 5-43090 | 6/1993 | Japan . |

*Primary Examiner*—Jeffrey Hofsass
*Assistant Examiner*—Ashok Mannava
*Attorney, Agent, or Firm*—Sughrue, Mion, Zinn, Macpeak & Seas

[57] ABSTRACT

An obstacle detecting apparatus including a light projecting assembly for projecting the laser light generated in a laser light emitting element through a light emitting path, a light introducing assembly for introducing the laser light reflected by an obstacle into a light receiving element through a light receiving path, and a driving motor for driving the light emitting assembly and at least a portion of the light introducing assembly. The light path in the light projecting assembly is different from the light introducing path, and a distance to the obstacle is obtained based on a propagating delay time from emitting the laser light by the laser light emitting element until receiving the laser light by the laser light receiving element. Also included is a direction detecting device for detecting a direction in which the laser light is projected, a light emission level detecting device for detecting a strength of the laser light, a stain detecting device for detecting stains on the housing, and a cleansing device for sweeping the surface of the housing.

32 Claims, 9 Drawing Sheets

FIG.6
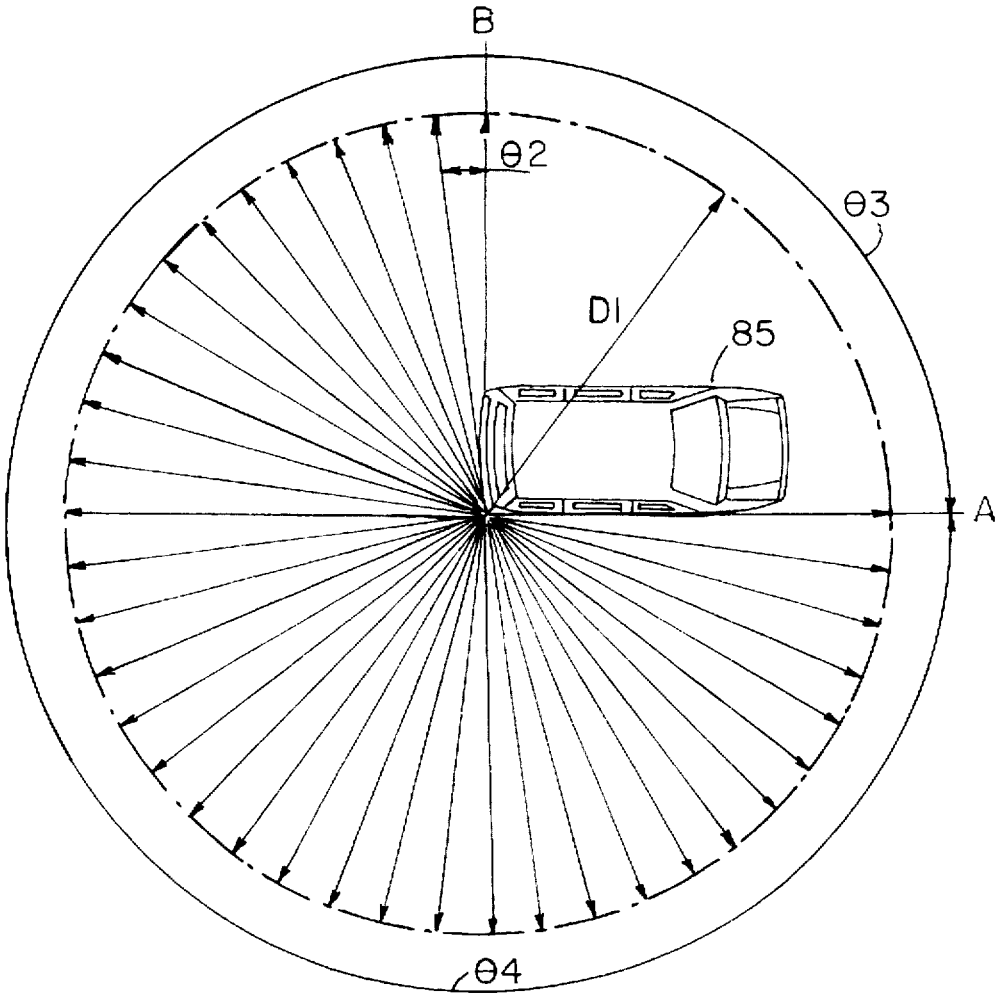
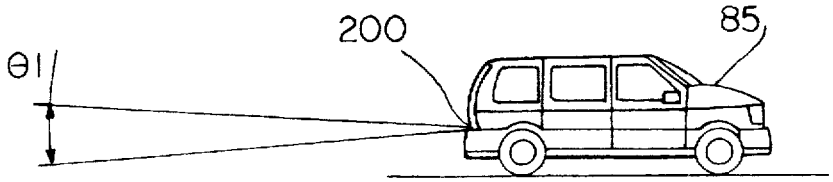
FIG.7

FIG. 10
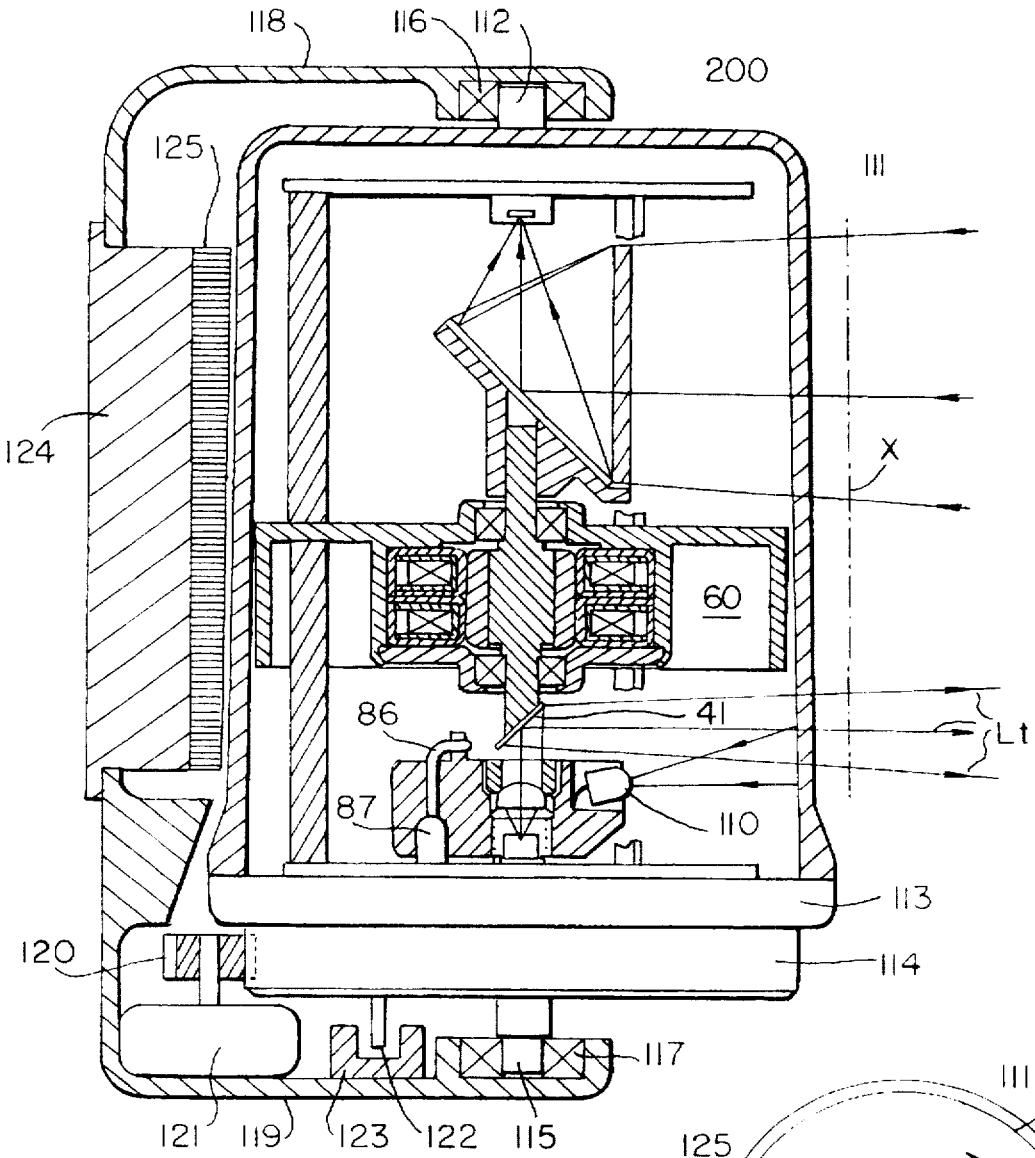
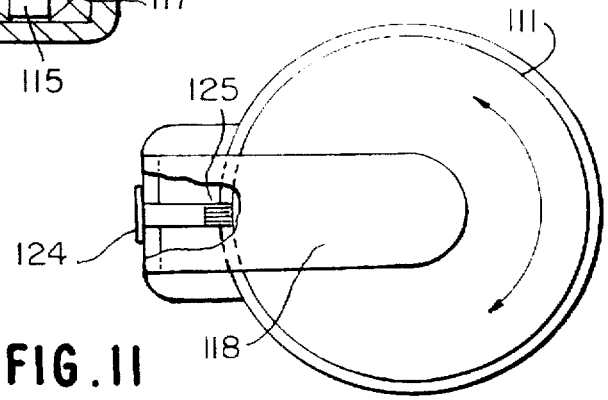
FIG. 11

OBSTACLE DETECTION APPARATUS FOR VEHICLES

BACKGROUND OF THE INVENTION

1. Field of the Invention

This invention relates to an obstacle detection apparatus for vehicles using a laser-radar scanning apparatus, for instance, and more particularly to an obstacle detection apparatus capable of scanning a wide range in the vicinity of a vehicle.

2. Description of the Related Art

Various techniques have been utilized in the past to detect the size of an obstacle ahead of a vehicle, the direction of the obstacle, and a distance from the vehicle to the obstacle, by scanning a laser beam projected ahead of the vehicle.

In particular, in order to perform a wide range detection of the obstacle by employing a laser radar, techniques using a polyhedral angle mirror (a so called "polygon mirror") rotatably driven as shown in Japanese examined patent publication Hei 5-43090, and using a half mirror (a so called "isolator") rotatably driven as shown in Japanese un-examined patent publication No. Hei 3-175390 are known.

FIG. 13 illustrates an example of the obstacle detection apparatus using the above mentioned half mirror technique shown in Japanese un-examined patent publication No. Hei 3-175390.

In FIG. 13, a laser diode 100 generates a pulse laser beam (which is a diffused light) when it receives pulse current from a driving circuit (not shown). Approximately one-half of the pulse laser beam passing through a slit 107 is reflected toward the left in FIG. 13 by a half mirror 101, and the rest of the beam is passed through the half mirror 101 and slit 109, and is then converted to a parallel beam by a concave mirror 102.

The parallel beam is projected externally via a transparent plate 104 provided for preventing dust or other debris from entering the detection apparatus, and the beam is horizontally moved through rotation of the concave mirror 102 by a motor 103 so that the detection apparatus can scan over 360°.

The laser beam projected to the external space is reflected by a obstacle such as a proceeding car, and a part of the reflected beam is directed back again to the concave mirror 102 via the plate 104 and reflected toward the half mirror 101.

Almost one-half of the reflected beam is reflected again by the half mirror 101 and then focused on a photo diode 106 through slit 108, by which photo-electro transducing takes place to output an electric signal corresponding to the strength of the reflected light beam.

The distance to the obstacle is obtained based on the time difference between the time when the light is emitted from the laser diode 100 until the time the light is received at the photo diode 106, and a direction of the obstacle is derived from the rotated position of the concave mirror 102.

In the above-described conventional obstacle detecting apparatus, since it is necessary for transmitted laser light to be passed through the half mirror 101, the output level of the laser beam is lowered due to the light splitting, and the distance capable of being measured by the laser radar apparatus is considerably shortened. In order to compensate for the above problem, an expensive laser diode with a large output level is necessary.

In the conventional apparatus it is likely that the photo diode will detect light other than the light reflected by the obstacle, resulting in a lessening of the detection sensitivity of the laser radar apparatus. In order to prevent this deterioration, it is necessary to provide numerous slits and to assemble the optical parts such as the concave mirror and the half mirror with high accuracy.

Moreover, the above conventional laser radar apparatus cannot easily and accurately detect the starting point of scanning, and also cannot detect a lowering in performance due to the attachment or deposition of stains on the transparent plate 104, nor can the apparatus sweep the stains out.

SUMMARY OF THE INVENTION

Accordingly, an object of present invention is to provide an obstacle detecting apparatus which is capable of performing a wide range detection of obstacles without resulting in lowering of the output level.

Another object of the invention is to provide an obstacle detecting apparatus which can easily and steplessly control a spreading angle of the light projected toward an external space.

A further object is to provide an obstacle detecting apparatus in which the improper operation of the apparatus due to noise and other interference can be avoided.

Still another object is to provide an obstacle detecting apparatus in which a scanning operation is not hindered by parts and wirings incorporated into the apparatus.

Another object of the invention is to provide an obstacle detecting apparatus containing a light emission detection means capable of detecting that the light has been transmitted in a predetermined direction, and, upon such detection, detecting a direction that the light is projected in.

Still another object is to provide an obstacle detecting apparatus capable of diagnosing a light mission level of a photo diode.

Yet another object is to provide an obstacle detecting apparatus capable of automatically detecting and sweeping out the stains attached or deposited on the surface of a housing of the obstacle detecting apparatus.

A still further object is to provide an obstacle detecting apparatus which is capable of automatically controlling the region to be scanned to within a predetermined angle range.

A further object is to provide an obstacle detecting apparatus having fewer parts, which is of a smaller size, and which is lighter in weight.

The above objects are accomplished in the instant invention by providing an obstacle detecting apparatus comprising: a light emitting means; a light projecting means for projecting a light generated in said light emitting means in a predetermined direction via a light emitting path; a light introducing means for introducing the light reflected by an obstacle via a light receiving path that is different from said light emitting path; a light receiving means for detecting the light introduced by said light introducing means; a driving means for rotatably supporting said light projecting means and at least a portion of said light introducing means, and for driving said light projecting means and said at least a portion of said light introducing means in a circumferential direction; and a calculating means for calculating a distance to the obstacle based on a delay time between a time the light is emitted by said light emitting means and a time the light is received by said light receiving means.

In another embodiment, the above objects are attained by providing an obstacle detecting apparatus comprising: a housing; a first substrate disposed at a light projecting end of said housing; a laser light emitting element disposed on said first substrate; a light projecting assembly for projecting outwardly the laser light generated by said laser light emitting element through a predetermined light emitting path; a light introducing assembly for introducing the laser light reflected by an obstacle into said housing through a light receiving path that is different from said light emitting path; a second substrate disposed so as to face said first substrate at a light receiving end of said housing; a laser light receiving element disposed on said second substrate for receiving said introduced laser light; a motor for driving circumferentially said light emitting assembly and at least a portion of said light introducing assembly; a counter for calculating a distance to the obstacle based on a delay time between a time the laser light is emitted by said laser light emitting element until a time the light is received by said laser light receiving element; and a supporting member for supporting said first and second substrates and said motor.

BRIEF DESCRIPTION OF THE DRAWING FIGURES

FIG. 6 is a plan view of a fourth embodiment of the invention illustrating an operation in the case where a laser radar apparatus is installed in a vehicle.

FIG. 7 is a side view of FIG. 6.

FIG. 10 is a sectional view of a seventh embodiment of the invention.

FIG. 11 is a partially broken plan view of FIG. 10.

DETAILED DESCRIPTION OF THE PREFERRED EMBODIMENTS

A first embodiment of the present invention will be described below with reference to the accompanying drawings.

Figure 1:
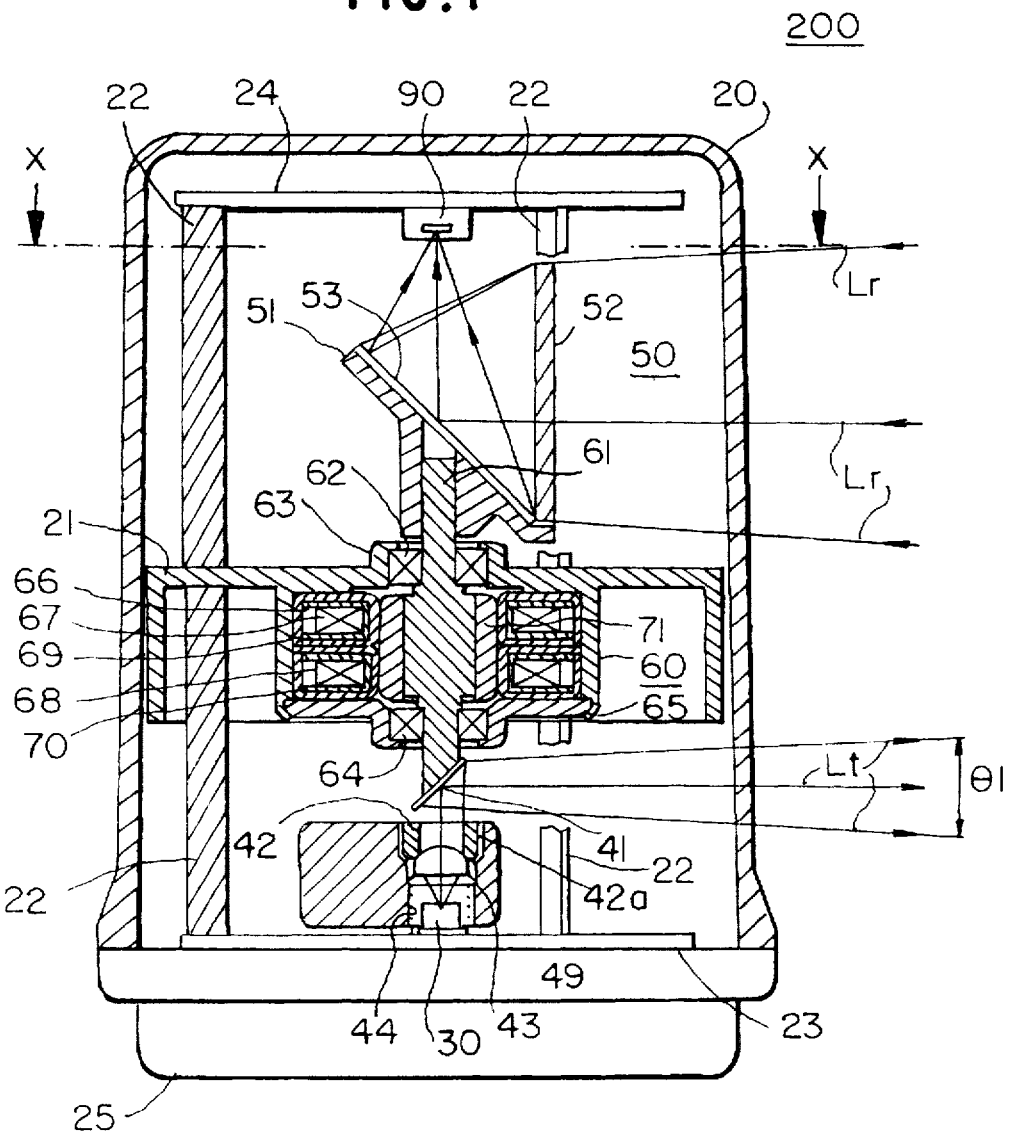
FIG. 1 is a sectional view showing an obstacle detecting apparatus of a first embodiment of the invention.

FIG. 1 is a sectional view showing an internal configuration in the first embodiment of the obstacle detection apparatus according to present invention.

Referring to FIG. 1, a laser radar apparatus 200 as an example of the obstacle detection apparatus of this invention is provided with a protective housing 20 made of a transparent material, a laser diode 30 from which a laser light is generated, a light projecting assembly 40 which guides or conducts the emitted laser light to be projected toward the external space, a light introducing assembly 50 which guides or conducts the laser light reflected by the obstacle such as a car to a light receiving element 90, and a stepping motor 60 for scanning the laser light in a circumferential direction.

The stepping motor 60 is constituted by a motor shaft 61 which is rotatably supported by a bearing 62 inserted in a motor-housing 63 and a bearing 64 inserted in a cap 65. On a part of the motor shaft 61, a cylindrical magnet 71 magnetized according to the number of steps is fixed, and on the periphery of the magnet 71, a stator 66 is installed in the motor-housing 63 through an air gap and in which coils 67, 68 are also installed through bobbins 69, 70.

The lower end of the shaft 61 is cut at 45 degrees with respect to the shaft-axis and is firmly attached with a mirror 41 which is a part of the light projecting assemblies 40 described below.

On the upper end of the shaft 61, a holder 51 is firmly attached, as a part of the light introducing assembly 50. The light receiving lens 52 is perpendicularly held by the holder 51, and faces in the same circumferential direction as the mirror 41.

The holder 51 also holds a mirror 53 at an angle of 45 degrees with respect to the shaft-axis. The mirror 53 has larger surface area than that of the mirror 41.

A partition 21 is formed as a part of the motor housing 63 and has a cylindrical shape with the one end closed and the other opened. This partition 21 is supported by supporting members 22, 22, 22, each of those being arranged with 120 degrees separation (see FIG. 2).

Further, the supporting members 22, 22, 22 are made of transparent material through which a wavelength of laser light is transmitted.

A printing board 23 having a laser light emitting circuit is mounted on the bottom of the supporting members 22, 22, 22 and the laser diode 30 is mounted on the printing board 23.

The laser diode 30 is incorporated in a holding member 49 and securely held through a light collecting lens 43 with another holding member 42 which is screwed into the holding member 49 via a screw part 42*a* against the pressure of a spring 44.

On the other hand, another printing board 24 having a light receiving circuit is mounted on the top end of the supporting member 22, 22, 22, and a photo diode 90, for example, as the light receiving element is mounted on the printing board 24.

The printing board 24 is supported in a position such that the light receiving portion of the photo diode 90 is placed on the axis of the motor-shaft 61 and on the focal point of the light receiving lens 52 or in a vicinity thereof.

The light shaft in the vertical direction of the laser light passing through the laser diode 30, light collecting lens 43, mirrors 41, 53 and photo diode 90 is aligned with the rotating axis of the motor-shaft 61.

The housing 20 is made of transparent material through which a wavelength of laser light is transmitted, and is secured into protective base 25 by means of a liquid-tight seal.

Figure 2:
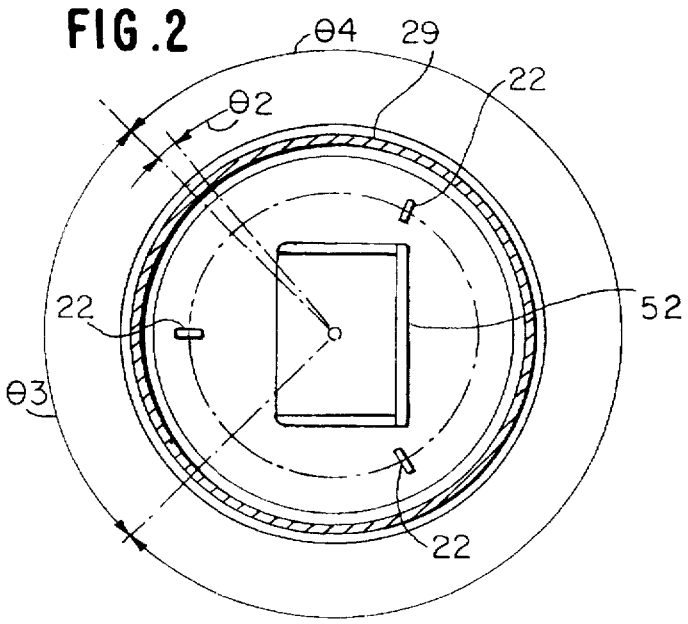
FIG. 2 is a sectional view taken along line X—X of FIG. 1.

The operation of this embodiment will now be described with reference to FIGS. 1–3.

The laser light emitted from the laser diode 30 is horizontally projected through the light emitting path containing the light collecting lens 43, the mirror 41 and the armor housing 20.

Figure 3:
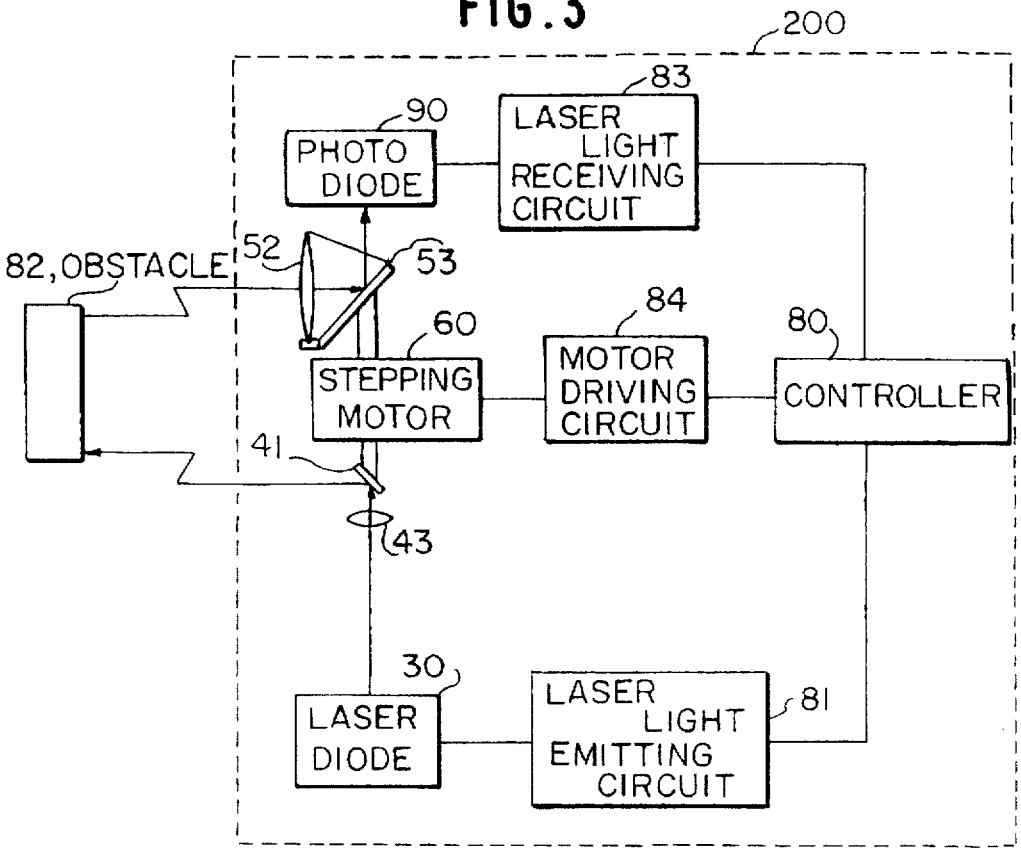
FIG. 3 is a block diagram of a first embodiment of the present invention.

As shown in FIG. 3, a laser light emitting circuit 81 receives instructions from a controller 80 comprising, for example, a micro-computer, to provide the laser diode 30 with pulse current.

The laser diode 30 generates laser light with the output level according to the magnitudes of the pulse current, and the laser light is inherently a diffused light but is collected to a predetermined spreading angle θ1 (referring to FIG. 1) by the light collecting lens 43 and outwardly projected by the mirror 41. The above predetermined spreading angle θ1 can be controlled to any angle by adjusting the position of the light collecting lens 43 through rotating the holding member 42. The above outwardly projected light Lt is reflected by an obstacle 82 such as a preceding car and is reflected back to the apparatus 200 through the light receiving lens 52 by which the light is collected to be reflected by the mirror 53 and focused on the light receiving portion or in a vicinity thereof of the photo diode 90. The photo diode 90 detects the light and transforms the light into electrical signals to be amplified by the laser light receiving circuit 83 and then to be input into the controller 80.

The controller 80 contains a distance calculation means (not shown), which calculates a distance to the obstacle by measuring a propagation delay time (t that is a time interval from emitting of laser light at the laser diode 30 until receiving of laser light reflected by the obstacle 82 at the photo diode 90.

The distance D is calculated by the following formula.

$$D=v\times\Delta t/2$$

where: v represents the velocity of light

The controller 80, after executing the above series of operations, provides a motor driving circuit 84 with instruction signals to rotate the stepping motor 60 by an angle θ2 and to repeat this operation stepwise, so that the laser radar apparatus 200 is circumferentially scanned so as to cover a wide range of horizontal angles.

The controller 80 contains a direction detecting means (not shown) to detect a direction toward which laser light is being projected by using well known techniques such as employed in an encoder system or a stepping motor system for detecting the angle by which the rotor shaft 61 has been rotated from a reference position.

The first embodiment described above can be modified as described below.

First, the instruction signals output from the controller 80 for driving the stepping motor 60 can be generated simultaneously with output signals from an oscillator separately installed.

Second, the stepping angle θ2 can be easily changed by altering an output level of the instruction signals to the motor driving circuit 84, thereby controlling a scanning speed of the laser light.

Third, the scanning speed of the laser light can be also controlled by altering a period of the instruction signals to the motor driving circuit 84.

As can be understood, according to the above first embodiment, since a light emitting path and a light receiving path are not overlapped, that is, they are independent from each other, it is not necessary to use an isolator for separation of laser light, thereby eliminating the problem of a deterioration of laser light caused by the isolator.

Further, since the mirror 41, according to the first embodiment, is disposed close to laser diode 30, the mirror 41 can be formed in smaller size than the mirror 53, thereby enabling the stepping motor 60 and the motor driving circuit 84 to be smaller and lighter, because a driving force of the stepping motor can be reduced.

Furthermore, since the holding member 42 which holds the light emitting lens 43 is screwed into the holder member 49, the position control of the light emitting lens 43 is easily and steplessly achieved.

According to the first embodiment, since the partition 21 is disposed between the light emitting path and the light receiving path, light interference therebetween is prevented, resulting in improved reliability, and that reliability is further improved if the partition 21 is formed of electrically conductive material like metal, because not only laser light but also an electromagnetic field are shielded. In addition, an electromagnetic noise generated from the laser diode, for example, is prevented from interfering with, or causing misoperation of, the light receiving circuit.

The separate arrangement of the printing board 23 and the printing board 24 also contributes to preventing misoperation of the light receiving circuit.

Figure 4:
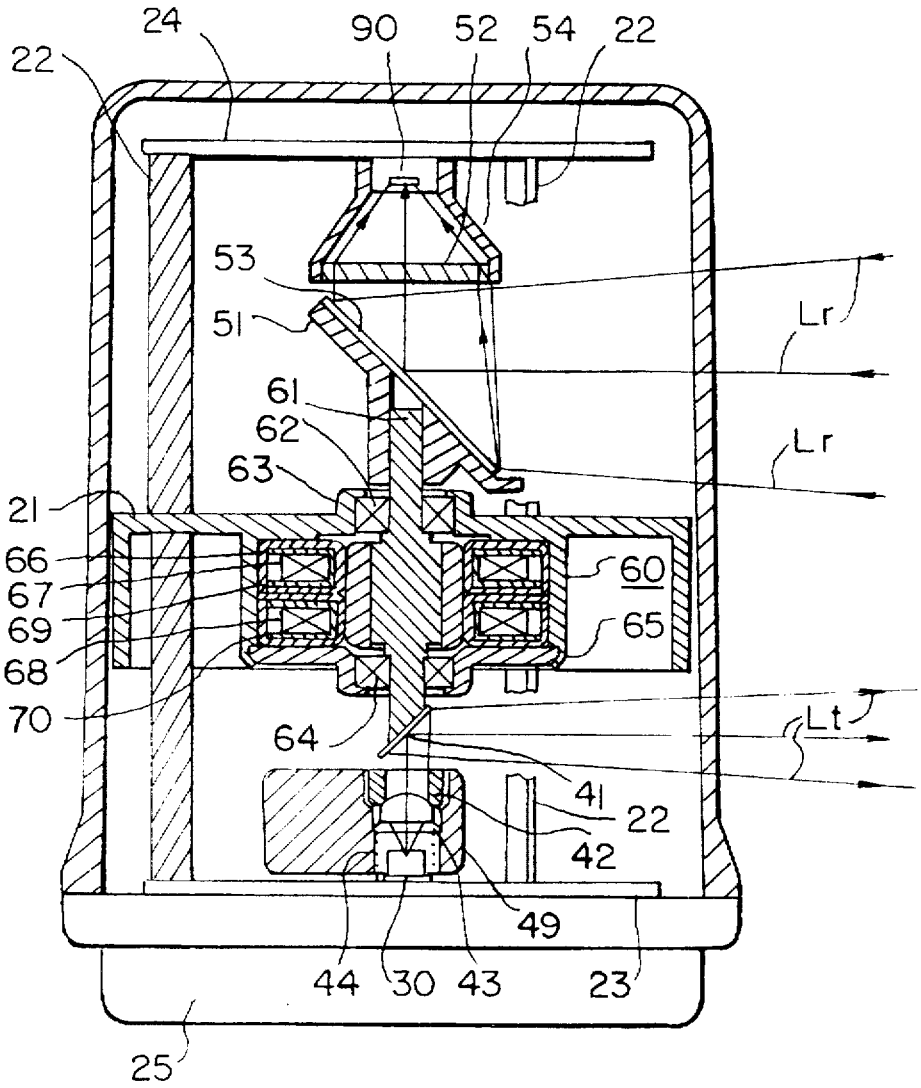
FIG. 4 is a sectional view showing an obstacle detecting apparatus of a second embodiment of the invention.

FIG. 4 illustrates a second embodiment of the present invention.

The reference numerals in FIG. 4 that are identical to those in FIG. 1 represent identical or similar parts to those in FIG. 1. The second embodiment differs from the first embodiment in the configuration of the light receiving lens.

In FIG. 4, the laser light Lr reflected by the obstacle 82 is reflected by the mirror 53 and then collected by the light receiving lens 52 to be focused on the light receiving surface of the photo diode 90.

The light receiving lens 52 is held by a holder 54 secured on the printing board 24 so that the light receiving lens 52 is positioned in line with the rotating axis of the motor shaft 61, and the focal point of the lens 52 is positioned on the light receiving surface of the photo diode 90.

According to FIG. 4, the lens 52 is held by the holder 54, and the holder 51 is not needed to hold the lens 52, so the driving force of the stepping motor 60 can be reduced, thereby enabling the motor size to be smaller, and enabling the lens 52 to be easily set to accurately focus on the surface of the photo diode 90.

Figure 5:
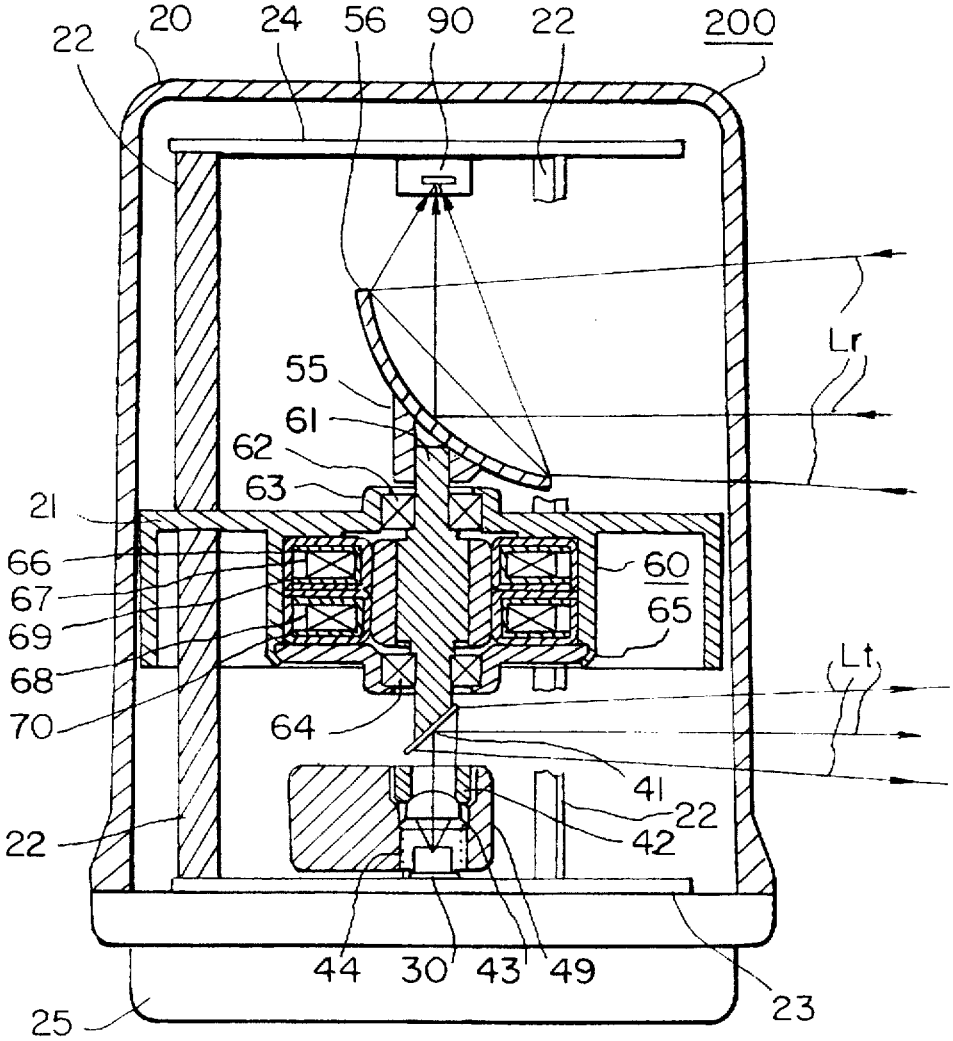
FIG. 5 is a sectional view of a third embodiment of the invention.

FIG. 5 illustrates a third embodiment of the invention.

The reference numerals in FIG. 5 that are identical to those in FIG. 1 represent identical or similar parts to those in FIG. 1. This embodiment differs from the previous embodiments in that a concave mirror is used instead of the combination of the light receiving lens and the light receiving mirror.

In FIG. 5, the laser light Lr reflected by the obstacle 82 is further reflected by a concave mirror 56 secured on a holder 55, and then directly focused on the light receiving surface of the photo diode 90.

According to this embodiment, the number of parts is reduced thereby enabling the apparatus to be smaller.

FIG. 6 is a plan view of a fourth embodiment of the invention illustrating an operation in the case where a laser radar apparatus was installed in a vehicle. FIG. 7 is a side view of FIG. 6.

In the drawings, the laser radar apparatus 200 is installed on a back corner of the vehicle 85, and as described in the first embodiment, the apparatus 200 circumferentially scans step by step by angle increments of θ2.

This scanning is, however, interfered with by the body of the vehicle within the range of θ3.

In this embodiment, the controller 80 contains a prohibiting circuit (not shown) which prevents the apparatus 200 from projecting the laser light when the scanning angle is in the range of θ3.

The above prohibiting circuit is known in the art and utilizes the output signals from the direction detecting means in which the scanning angle from the reference position is detected.

According to this embodiment, the controller 80 avoids unnecessary operation and calculation. In order to avoid the possibility that the laser light will interfere with the wirings which connect between the printing board 23 and printing board 24 within the range of angle θ4, the wiring is contained within the range θ3.

Figure 8:
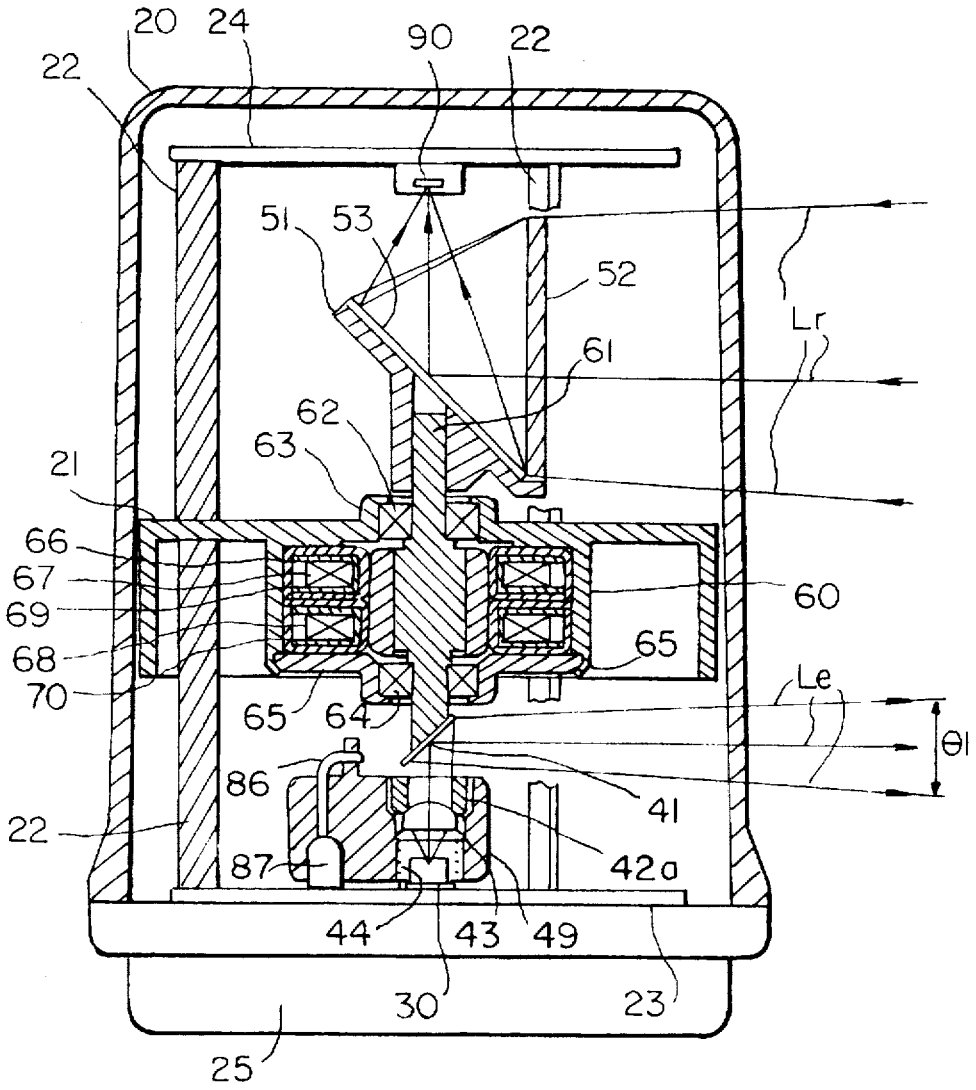
FIG. 8 is a sectional view showing an obstacle protecting apparatus of fifth and sixth embodiments of the invention.
Figure 9:
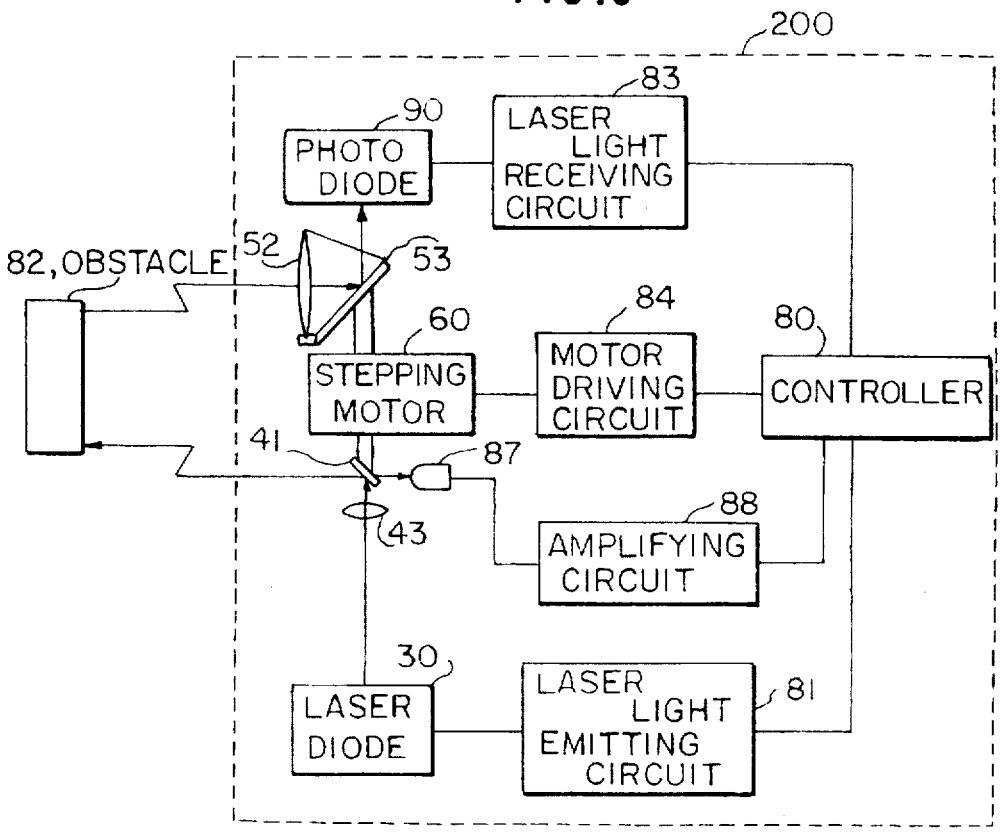
FIG. 9 is a block diagram of the fifth embodiment of the invention.
Figure 13:
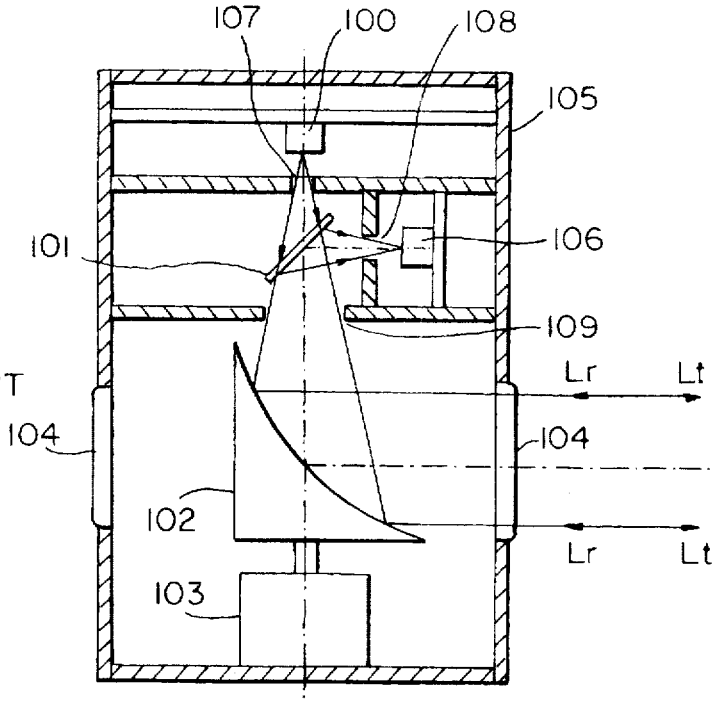
FIG.13 PRIOR ART
FIG. 13 is a sectional view showing a conventional laser radar apparatus.

FIGS. 8 and 9 illustrate a fifth embodiment of the invention, having a scanning origin detecting function. In the drawings, the numeral 86 represents an optical fiber which is provided at the origin from which the laser light begins scanning, which is a predetermined rotating position of the motor shaft 61, to directly receive the reflected light from the mirror 41. The numeral 87 is a light receiving element such as a photo diode, to receive the light conducted through the optical fiber 86.

In operation, when the mirror 41 which is stepwise rotated by the motor shaft 61 faces the optical fiber 86, the laser light reflected by the mirror 41 is conducted to the photo diode 87 through the optical fiber 86. The photo diode 87 detects the light and converts the light to electric signals according to the strength of the light. Further, the electric signals are amplified by an amplifying circuit 88 (see FIG. 9) and then input to the controller 80 as an origin signal. The controller 80 executes a predetermined calculation based on the origin signal and the position signals of the stepping motor 60 at the time when it received the origin signal, and stores the scanning origin detecting signal into a memory means (not shown) installed in the controller 80.

As can be seen, the scanning origin detecting means is operable only at the time the mirror 41 is facing the optical fiber 86, and is not operable at the time the mirror 41 is facing in the other direction.

The scanning origin detecting means can also be used for detecting a direction toward which the laser light is projected. That direction is, for example, calculated from the step angle θ2 mentioned above and a counting value of the number of steps by the stepping motor 60 after the controller 80 has received the origin signal.

A sixth embodiment is directed to a laser radar apparatus having a self diagnostic function by which a light emitting strength can be monitored.

This embodiment can be explained using the same drawings FIGS. 8 and 9 as the last embodiment.

In FIG. 8, the optical fiber 86 and photo diode 87 are also utilized as a light emission strength detecting means for detecting a light emission level of the photo diode 30.

In operation, when the mirror 41 which is stepwise rotated by the motor shaft 61 is facing the optical fiber 86, the laser light reflected by the mirror 41 is conducted to the photo diode 87 through the optical fiber 86. The photo diode 87 detects the light and converts the light to electric signals according to the strength of the light. Further, the electric signals are amplified by an amplifying circuit 88 (see FIG. 9) and then input to a comparator (not shown) contained in the controller 80 to compare it with a reference value which represents a standard light strength. The comparator outputs a comparison result as either "yes" or "no". When, for instance, the light strength of the detected light is larger than the reference value, the comparator outputs a "no" signal to show a deterioration or a defect of parts such as the laser diode 30 or the laser light emitting circuit 81.

Figure 12:
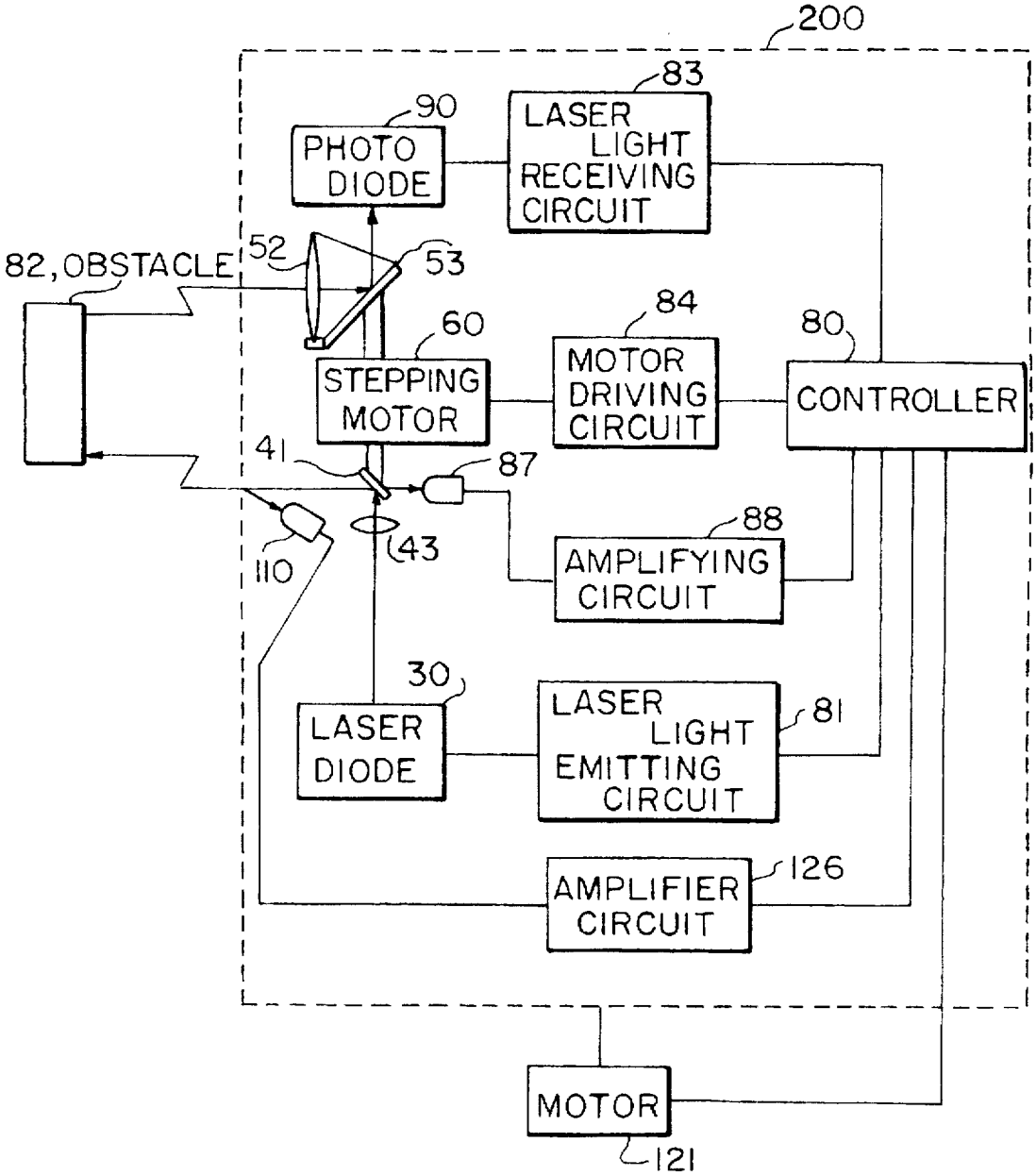
FIG. 12 is a block diagram of the seventh embodiment of the invention.

FIGS. 10–12 illustrate a seventh embodiment having a stain detection function and stain cleansing function. FIG. 10 is a sectional view of the seventh embodiment, and FIG. 11 is a partially broken plan view of FIG. 10.

In the drawings, the numeral 110 represents a laser light receiving means such as a photo diode for detecting any light obstructing materials such as dust, dirt or snow attached or deposited on a surface X of a protective housing 111. The protective housing 111 is securely mounted on a protective base 113 on the peripheral surface of which a gear 114 is provided. The housing 111 and the base 113 have a rotating shaft 112 and 115, respectively, at the center part thereof, and are rotatably mounted on supporting means 118 and 119, respectively, by being coupled with bearings 116 and 117, respectively. A motor 121 is a driving means for rotating the housing comprising the housing 111 and the base 113 by means of a gear coupling between a pinion gear 120 secured on the shaft of the motor 121 and the above mentioned base gear 114.

The rotating angle of the housing is detected by means of a position detecting means comprising a slit 122 and a sensor 123. A brush 125 is secured on a wiper means 124 which is supported by supporting members 118 and 119, and is contacted with the outer periphery of the housing 111 to sweep away the attached or deposited materials by rotating the housing.

The operation of this embodiment is described on referring to FIG. 12.

If the light obstructing material is attached or deposited on the surface X of the armor housing 111, a laser light outwardly projected by the mirror 41 as reflected inwardly again by the light obstructing material and received by the photo diode 110. The photo diode 110 operates as a photo electro transducer and outputs electric signals according to the strength or intensity of the received light. The electric signals are amplified by an amplifier circuit 126 and input into the controller 80. The controller 80 contains a stain detection means (not shown) in which the amplified signals from the amplifier circuit 126 are compared with a predetermined reference value. If the magnitude of the amplified signal is larger than the reference value, the stain detection means judges that the housing 111 has been stained, and the controller 80 accordingly outputs a driving signal to a motor 121 to rotate the housing so that the obstructing materials attached or deposited on the surface X of the armor housing 111 are swept away by the brush 125.

A rotation starting position of the housing is detected by the slit 122 and the sensor 123 and memorized in the controller 80, so that the housing can be easily returned to the original starting position after one or several rotations for sweeping away the obstructing particles.

The housing can also be rotated back and forth reciprocally, to enable the brush to sweep away the stains more effectively by adding to the controller 80 the capability to control a rotating angle of the housing.

Since the housing is rotatable, in this embodiment, it is necessary for a reference position of the housing to be previously determined, and to automatically set this reference position at the time of shipment.

Accordingly, the method for adjusting the housing to the reference position is described below.

When the laser radar apparatus 200 is installed on the back end of the vehicle 85 as shown in FIG. 6, the housing is placed in an arbitrary rotating position, therefore it is uncertain which way the scanning region θ4 is faced. Before adjusting, any obstacles other than a vehicle 85 are removed from the circle range having a radius D1 which is the longest detecting distance in the laser radar apparatus 200, so that the apparatus 200 detects only the vehicle 85.

By rotating the stepping motor 60 clockwise for example, the apparatus 200 is repeatedly scanned by an angle θ2 step by step to detect an obstacle. As explained above, since the controller 80 contains an obstacle detecting means (not shown) comprising a distance calculating means and a direction detecting means, when the laser light is projected in a direction A which is the body line of the vehicle 85, the obstacle detecting means detects the obstacle, and its output changes. The direction of the laser light can be determine by the controller 80 by counting the number of steps from the origin until the output of the obstacle detecting means changes. Based on the result, the controller 80 controls the rotation of the housing by the determined angle, so that the position of the origin can be set to position A.

The controller 80 also receives an output signal from the sensor 123 corresponding to the housing position, and stores the output signal in a memory means (not shown) as a reference position of the housing.

When the housing is rotated to sweep away the stains deposited on the surface thereof, the housing is brought back automatically to the original point A after the completion of the cleansing operation by a control means (not shown) contained in the controller 80. When the reference position of the housing is set to point B in FIG. 6, the position of the origin can be set to the position corresponding to a point in time when the output of the obstacle detecting means changes from that of detecting an obstacle to not detecting the obstacle.

In the above explanation on the seventh embodiment, the stepping motor 60 is assumed to be rotated counter-clockwise. If the motor 60 is rotated clockwise, the output change in the obstacle detecting means is the reverse of that described above. The scanning region θ4 in the seventh embodiment was adjusted as shown in FIG. 6 when the origin agreed with the reference position of the housing. However, the scanning region θ4 can be adjusted as shown in FIG. 6 when a predetermined position other than the origin is coincided with the reference position of the housing.

Although the present invention has been described and illustrated in detail above, it should be understood that the same is by way of illustration and example only, and is not to be taken by way of limitation, the spirit and scope of the present invention being limited only by the terms of the appended claims.

I claim:

1. An obstacle detecting apparatus, comprising:

a light emitting means;

a light projecting means for projecting a light generated in said light emitting means in a predetermined direction via a light emitting path;

a light introducing means for introducing the light reflected by an obstacle via a light receiving path that is different from said light emitting path over an entire length of said light emitting path and said light receiving path within said obstacle detecting apparatus;

a light receiving means for detecting the light introduced by said light introducing means;

a driving means for rotatably supporting said light projecting means and at least a portion of said light introducing means, and for driving said light projecting means and said at least a portion of said light introducing means in a circumferential direction; and a calculating means for calculating a distance to the obstacle based on a delay time between a time the light is emitted by said light emitting means until a time the light is received by said light receiving means.

2. The obstacle detecting apparatus of claim 1, wherein said light projecting means comprises:

a first light collecting means for collecting the light generated by said light emitting means; and a first reflecting means for reflecting said collected light in the predetermined direction.

3. The obstacle detecting apparatus of claim 2, further comprising a first holding means for holding said first light collecting means in a predetermined position.

4. The obstacle detecting apparatus of claim 3, wherein said first holding means comprises:

a first holding member for holding said first light collecting means;

a second holding member movably and adjustably connected with said first holding member and a spring biased between said first and second holding members.

5. The obstacle detecting apparatus of claim 1, wherein said light introducing means comprises:

a reflecting means for reflecting the introduced light in another predetermined direction; and a collecting means for collecting the light reflected by said reflecting means.

6. The obstacle detecting apparatus of claim 1, wherein said light introducing means comprises a reflecting member having a concave shape.

7. The obstacle detecting apparatus of claim 5, further comprising a support means on said driving means for supporting said reflecting means.

8. The obstacle detecting apparatus of claim 1, further comprising a partition member formed between said light projecting means and said light introducing means for preventing the light from interfering therebetween.

9. The obstacle detecting apparatus of claim 8, wherein said partition member is an electrically conductive material.

10. The obstacle detecting apparatus of claim 1, further comprising a prohibiting means for prohibiting said obstacle detecting apparatus from detecting the obstacle in a predetermined range of rotation of said driving means.

11. The obstacle detecting apparatus of claim 1, further comprising a light emitting origin detecting means provided at a predetermined position in rotation of said light projecting assembly for detecting a light projection direction at the predetermined position.

12. The obstacle detecting apparatus of claim 11, further comprising a direction detecting means for detecting a direction in which the laser light is projected based on the output from said light emitting origin detecting means.

13. The obstacle detecting apparatus of claim 11, further comprising a light emission level detecting means for detecting an intensity of the light projected from said light projecting assembly by comparing the output from said light emitting origin detecting means with a reference value.

14. An obstacle detecting apparatus comprising:

a housing;

a first substrate disposed at a light projecting end of said housing;

a laser light emitting element disposed on said first substrate;

a light projecting assembly for projecting outwardly the laser light generated by said laser light emitting element through a predetermined light emitting path;

a light introducing assembly for introducing the laser light reflected by an obstacle into said housing through a light receiving path that is different from said light emitting path over an entire length of said light receiving path and said light emitting path within said housing;

a second substrate disposed so as to face said first substrate at a light receiving end of said housing;

a laser light receiving element disposed on said second substrate for receiving said introduced laser light;

a motor for driving circumferentially said light emitting assembly and at least a portion of said light introducing assembly;

a counter for calculating a distance to the obstacle based on a delay time between a time the laser light is emitted by said laser light emitting element until a time the light is received by said laser light receiving element; and a supporting member for supporting said first and second substrates and said motor.

15. The obstacle detecting apparatus of claim 14, wherein said housing comprises a material through which the laser light can be transmitted.

16. The obstacle detecting apparatus of claim 14, wherein said supporting member comprises a material through which the laser light can be transmitted.

17. The obstacle detecting apparatus of claim 14, wherein said motor comprises:

a rotating shaft for rotating circumferentially said light projecting assembly and said light introducing assembly; and a motor housing having a cylindrical magnet, a coil and a stator.

18. The obstacle detecting apparatus of claim 14, wherein said light projecting assembly comprises:

a light projecting lens for collecting the laser light generated by said laser light emitting element; and a light projecting mirror for reflecting the collected laser light in a predetermined direction.

19. The obstacle detecting apparatus of claim 18, wherein, said motor shaft is cut at a lower end at an angle of 45° with respect to an axial direction of said shaft, and said light projecting mirror is attached to the lower end.

20. The obstacle detecting apparatus of claim 14, wherein said light introducing assembly comprises a reflecting member for reflecting the introduced laser light.

21. The obstacle detecting apparatus of claim 14, further comprising a partition between said light projecting assembly and said light introducing assembly for preventing the light from interfering therebetween.

22. The obstacle detecting apparatus of claim 21, wherein said partition is supported at a predetermined position by said supporting member.

23. The obstacle detecting apparatus of claim 14, further comprising a prohibiting means for prohibiting said obstacle detecting apparatus from detecting the obstacle in a predetermined range of rotation of said motor.

24. The obstacle detecting apparatus of claim 14, further comprising a light emitting origin detecting means provided at a predetermined position in rotation of said light projecting assembly for detecting a light projection direction at the predetermined position.

25. The obstacle detecting apparatus of claim 14, further comprising:

a reflected light detecting means provided inside said housing for detecting light reflected inwardly by said housing; and a stain detecting means for detecting stains on said housing by comparing the output from said reflected light detecting means with a reference value.

26. The obstacle detecting apparatus of claim 25, further comprising:

a housing supporting means for rotatably supporting said housing;

a housing driving means for rotating said housing;

a control means for supplying said housing driving means with a driving signal based on the output from said stain detecting means; and a cleansing means provided on said housing supporting means for sweeping a surface of said housing.

27. An obstacle detecting apparatus, comprising:

a housing;

a partition disposed in said housing;

light emitting means disposed on a first side of said partition inside said housing;

a first mirror disposed on said first side of said partition inside said housing for reflecting a light generated by said light emitting means through a first portion of said housing and toward an obstacle to be detected;

light receiving means disposed on a second side of said partition inside said housing opposite said first side for detecting the light reflected from the obstacle;

a second mirror disposed on said second side of said partition inside said housing for reflecting the light reflected by the obstacle through a second portion of said housing and toward said light receiving means;

driving means for rotatably driving said first and second mirrors; and calculating means for calculating a distance to the obstacle based on a delay time between a time when the light is emitted by said light emitting means and a time the light is received by said light receiving means.

28. An obstacle detecting apparatus as recited in claim 27, further comprising a shaft for supporting said first and second mirrors, wherein said shaft extends on both sides of said partition, and wherein said first mirror is supported on one end of said shaft on said first side of said partition, and said second mirror is supported on an opposite end of said shaft on said second side of said partition.

29. An obstacle detecting apparatus as recited in claim 28, wherein said shaft is a motor shaft.

30. An obstacle detecting apparatus, comprising:

a housing;

light emitting means disposed in said housing;

a first mirror disposed in said housing for reflecting a light generated by said light emitting means through a first portion of said housing and toward an obstacle to be detected;

light receiving means disposed in said housing for detecting the light reflected from the obstacle;

a second mirror disposed in said housing for reflecting the light reflected by the obstacle through a second portion of said housing and toward said light receiving means, wherein said first and second mirrors are different, and wherein said first and second portions of said housing are also different;

driving means for rotatably driving said first and second mirrors; and calculating means for calculating a distance to the obstacle based on a delay time between a time when the light is emitted by said light emitting means until a time the light is received by said light receiving means.

31. An obstacle detecting apparatus as recited in claim 30, further comprising a partition disposed between said first and second mirrors for preventing interference between said light emitting means and said light receiving means.

32. An obstacle detecting apparatus as recited in claim 31, wherein said shaft is a motor shaft.

* * * * *